US006415124B1

(12) United States Patent
Nishikawa

(10) Patent No.: US 6,415,124 B1
(45) Date of Patent: Jul. 2, 2002

(54) WET-TYPE DEVELOPING UNIT CAPABLE OF REDUCING PRESSING POWER GIVEN TO SQUEEZE ROLLER AND CAPABLE OF CONTROLLING TONER DENSITY OF LIQUID DEVELOPER ADHERED ON DEVELOPMENT ROLLER

(75) Inventor: Hiroshi Nishikawa, Niigata (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/717,314

(22) Filed: Nov. 22, 2000

(30) Foreign Application Priority Data

Nov. 26, 1999 (JP) ..... 11-335322

(51) Int. Cl.[7] ..... G03G 15/10

(52) U.S. Cl. ..... 399/237; 399/57; 399/240; 399/249

(58) Field of Search ..... 399/237, 239, 399/240, 249, 274, 284, 49, 53, 57; 430/117

(56) References Cited

U.S. PATENT DOCUMENTS 5,689,779 A * 11/1997 Miyamoto et al. ..... 399/237
5,826,149 A * 10/1998 Horri et al. ..... 399/240
5,950,254 A * 9/1999 Kim ..... 399/237
6,104,891 A * 8/2000 Maebashi et al. ..... 399/53 X
6,104,901 A * 8/2000 Imamiya ..... 399/249
6,278,849 B1 * 8/2001 Kawasaki ..... 399/284 X
6,321,053 B1 * 11/2001 Shindo ..... 399/237

FOREIGN PATENT DOCUMENTS

JP 2795395 B2 6/1998
JP 11-194622 * 7/1999
JP 11-194623 * 7/1999
JP 11-231743 8/1999

* cited by examiner

*Primary Examiner*—Sophia S. Chen
(74) *Attorney, Agent, or Firm*—McGinn & Gibb, PLLC

(57) ABSTRACT

In a wet-type developing unit (300), a plating roller (400) is disposed parallel to a development roller (110) at a predetermined distance. The plating roller (400) is connected to a variable power source (402) controlled by a voltage controller (404). The plating roller (400) is supplied with a voltage from the variable power source (402) and has an electric potential higher than that of the development roller (110) to move charged particle toners included in a liquid developer film adhered on the development roller (110) toward the development roller (110). The plating roller (400) reduces thickness of the liquid developer film and increase a solid component ratio of the liquid developer film. When the solid component ratio is large, pressure given by a squeezed roller (118) can be smaller.

13 Claims, 6 Drawing Sheets

RELATED ART

WET-TYPE DEVELOPING UNIT CAPABLE OF REDUCING PRESSING POWER GIVEN TO SQUEEZE ROLLER AND CAPABLE OF CONTROLLING TONER DENSITY OF LIQUID DEVELOPER ADHERED ON DEVELOPMENT ROLLER

BACKGROUND OF THE INVENTION

This invention relates to a wet-type developing unit used in an electrophotographic apparatus, such as a laser printer, a facsimile, a copy machine, or the like, and in particular, relates to a wet-type developing unit for developing an electrostatic latent image formed on a photoreceptor belt.

A conventional wet-type developing unit comprises a development roller to develop an electrostatic latent image formed on a surface of a photoreceptor belt. That is, the development roller renders the electrostatic latent image visible with a liquid developer to form a visible image pattern on the surface of the photoreceptor belt. A squeeze roller is disposed next to the development roller so that its outer peripheral surface presses the surface of the photoreceptor belt. The squeeze roller rolls the visible image pattern and squeezes or removes excess liquid developer from the surface of the photoreceptor belt. A first backup roller is disposed so as to face the development roller across the photoreceptor belt and to press a back surface of the photoreceptor belt. The first backup roller maintains an even interval between the development roller and the photoreceptor belt. A second backup roller is disposed so as to face the squeeze roller across the photoreceptor belt and to support the photoreceptor belt pressed by the squeeze roller.

In the conventional wet-type developing unit, a solid structure or casing is necessary to press the photoreceptor belt with large pressing power by using the combination of the squeeze roller and the second backup roller. Accordingly, the conventional wet-type developing unit has a problem that it has large size and heavy weight for the strong structure.

Moreover, in the conventional wet-type developing unit, a toner density controller is necessary to deal with consumption of charged particle toners and with decrease of toner density. Accordingly, the conventional wet-type developing unit has a disadvantage that the toner density controller requires a large size for the wet-type developing unit and rises the cost of the wet-type developing unit.

Such a developing unit is disclosed in Japanese Unexamined Patent Publication No. 11-231743.

In the meantime, another conventional wet-type developing unit comprises a development roller. A supplying roller is disposed next to the development roller to supply liquid developer for the development roller. Bias voltage is supplied between the supplying roller and the development roller to increase toner density of the liquid developer adhered on the development roller. A squeeze roller is disposed next to the development roller at a predetermined interval to remove excess liquid developer from the development roller.

Though the conventional wet-type developing unit can change the toner density of the liquid developer adhered on the development roller, it is hard to control the toner density. In addition, both of the supplying roller and the squeeze roller require a large size for the conventional wet-type developing unit.

Such a developing unit is disclosed in Japanese Patent No. 2795395.

SUMMARY OF THE INVENTION

It is therefore an object of this invention to provide a wet-type developing unit which can reduce pressing power given to a squeeze roller.

It is another object of this invention to provide a wet-type developing unit which has a small size and is light in weight.

It is still another object of this invention to provide a wet-type developing unit which cm control a toner density of liquid developer adhered on a development roller.

In is still further object of this invention to provide a wet-type developing unit which is inexpensive.

Other object of this invention will become clear as the description proceeds.

According to the aspect of this invention, a wet-type developing unit is for developing by using liquid developer an electrostatic latent image formed on a photoreceptor. The liquid developer includes charged toners. The wet-type developing unit comprises a reservoir for reserving the liquid developer. A development roller has an outer peripheral surface wetted by the liquid developer reserved in the reservoir and forms a liquid developer film on the outer peripheral surface to developing the electrostatic latent image by using the liquid developer film. An electrode member is located at a predetermined distance from the outer peripheral surface and applied with a voltage to reduce thickness of the liquid developer film while moving the charged toner toward the development roller.

According to the another aspect of this invention, an electrophotographic apparatus comprises a wet-type developing unit for developing by using liquid developer an electrostatic latent image formed on a photoreceptor. The liquid developer includes charged toners. The wet-type developing unit includes a reservoir for reserving the liquid developer. A development roller has an outer peripheral surface wetted by the liquid developer reserved in the reservoir and forms a liquid developer film on the outer peripheral surface to developing the electrostatic latent image by using the liquid developer film. An electrode member is located at a predetermined distance from the outer peripheral surface and applied with a voltage to reduce thickness of the liquid developer film while moving the charged toner toward the development roller.

DESCRIPTION OF THE PREFERRED EMBODIMENT

Figure 1:
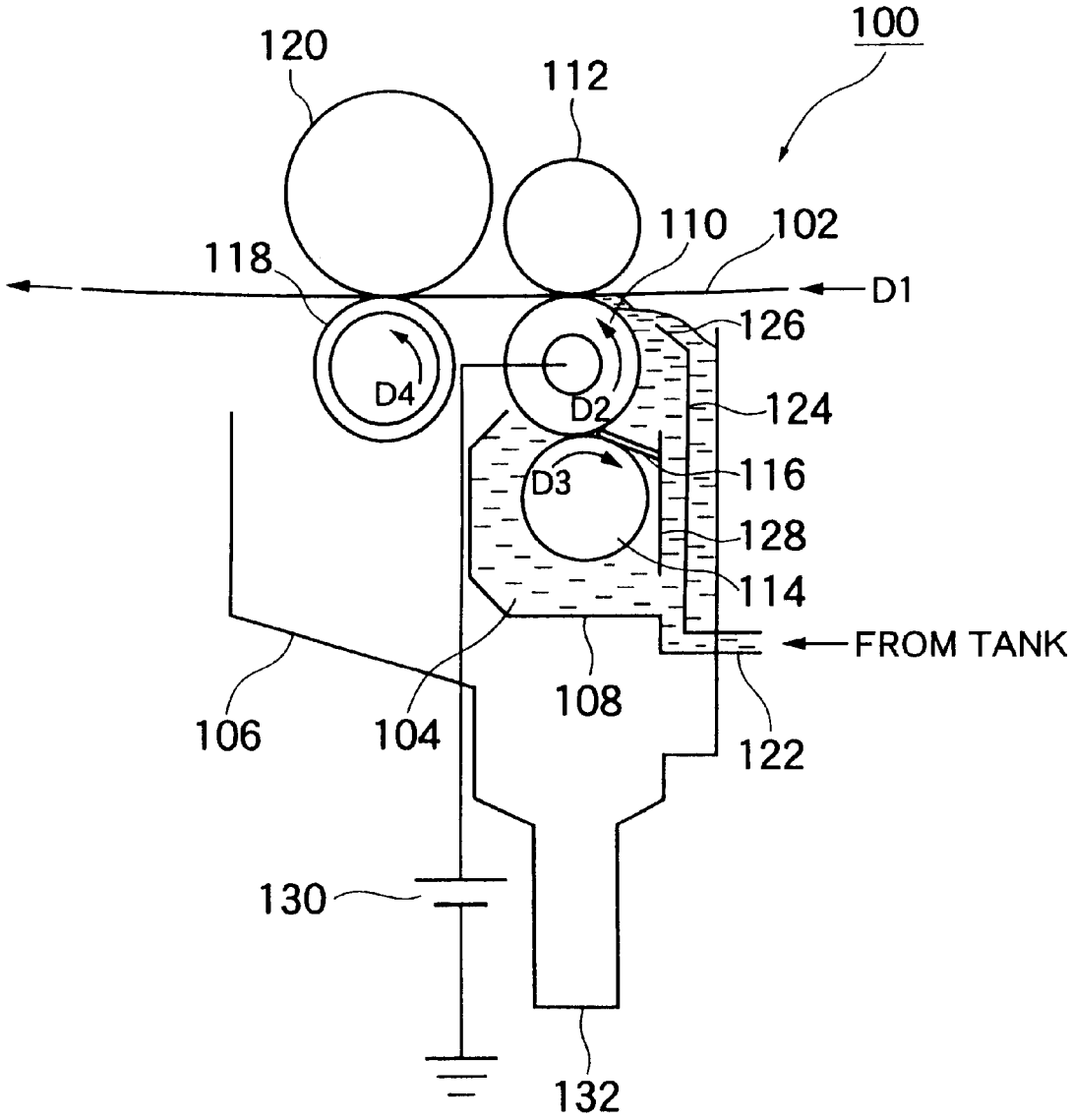
FIG. 1 PRIOR ART
FIG. 1 is a schematic drawing of a first conventional wet-type developing unit.

Referring to FIG. 1, description will be at first directed to a first conventional wet-type developing unit for a better understanding of this invention.

The first conventional wet-type developing unit 100 develops an electrostatic latent image formed on a surface of a photoreceptor belt 102 moving in a direction D1 shown in FIG. 1 by the use of liquid developer 104. The electrostatic latent image is corresponding to discharged areas formed by selectively exposing the charged photoreceptor belt 102 to light. The liquid developer 104 comprises charged particle toners which include coloring agents and resinous particles and which are dispersed in insulation liquid. The charged particle toners take positive charges. Hereinafter, a weight percentage (wt %) of the charged particle toners in the liquid developer 104 is called a solid component ratio.

The developing unit 100 comprises a unit housing 106 located under the photoreceptor belt 102. A reservoir 108 is disposed in the unit housing 106 and filled with liquid developer 104 during developing operation. A development roller 110 is disposed so as to be partially steeped in the liquid developer 104 reserved by the reservoir 108. A first backup roller 112 is disposed opposite to the development roller 110 across the photoreceptor belt 102. A cleaning roller 114 is disposed in contact with the development roller 110 in the reservoir 108. A cleaning blade 116 is pressed by the cleaning roller 114 to the development roller 110. A squeeze roller 118 is disposed next to the development roller 110 at the outside of reservoir 108. A second backup roller 120 is disposed opposite to the squeeze roller 118 across the photoreceptor belt 102.

The reservoir 108 is made of polyoxymethylene (POM), or urethane (e.g. urethane rubber or polyurethane) and has an intake 122 for taking liquid developer 104 supplied from a developer storage tank (not shown) through a pipe (not shown), and an inner wall 124 having a bent section 126 for guiding the liquid developer 104 from the intake 122 to the development roller 110. The reservoir 108 further has a subsidiary plate 128 for fixing the cleaning blade 116.

The development roller 110 is made of a metal, such as aluminum or stainless steel, and has a cylindrical shape. The development roller 110 is driven by a driving system (not shown) to rotate in a direction D2 and to carry the liquid developer 104 as a liquid developer film to a developing area between the development roller 110 and the photoreceptor belt 102. In addition, the development roller 110 is applied with a voltage from a power source 130 so as to generate developing electric field at the developing area. Consequently, the development roller 110 has electric potential higher than that of the discharged areas of the photoreceptor belt 102 by 300–500 volts. The developing electric field moves the charged particle toners existing in the developing area toward the discharged areas of the photoreceptor belt 102. Thus, the development roller 110 develops the electrostatic latent image and forms a visible image pattern.

The first backup roller 112 presses the photoreceptor belt 102 to maintain an even gap of the developing area. The gap is, for example, 0.15 mm.

A cleaning blade 116 has abase portion and an end portion. The base portion is fixed to the subsidiary plate 128. The end portion is pressed against the development roller 110 by the cleaning roller 114 and removes or scrapes the liquid developer 104 adhered on the development roller 110. That is, the cleaning blade 116 cleans an outer peripheral surface of the development roller 110.

The cleaning roller 114 has a coarse sponge rubber or a bristle at the periphery. The cleaning roller 114 presses the cleaning blade 116 and deforms it by 1–1.5 mm. The cleaning roller 114 is driven by the driving system in a direction D3 opposite to the direction D2. The cleaning roller 114 removes the liquid developer 104, which is scraped from the development roller 110 and which is adhered on the cleaning blade 116, and stirs the liquid developer 104 stored in the reservoir 108.

The squeeze roller 118 is rotatably supported by supporting, members (not shown) at the both sides. The supporting members are pressed toward the photoreceptor belt 102 by springs (not shown) and thereby the squeeze roller 118 presses the photoreceptor belt 102 by pressing power (or pressure) of 25–30 kg. The squeeze roller 118 rotates in the direction D4 to remove extra or excess liquid developer 104, which is not concerned with the visible image pattern, from the surface of the photoreceptor 102 and to increase the solid component ratio of the visible image pattern to 60–74 percents.

The second backup roller 120 supports the photoreceptor belt 102 against the squeeze roller 118.

The unit housing 106 has an outlet 132 and gathers the liquid developer 104 overflowed from the reservoir 108 in the outlet 132. The outlet 132 is connected to the developer storage tank through another pipe and the gathered liquid developer 104 is returned to the developer storage tank.

In the first conventional wet-type developing unit, the squeeze roller 118 must be strongly press the photoreceptor belt to increase density of the charged particle toners in the visible image pattern because a rate of the charged particle toners in the liquid developer 104 for the visible image pattern is small. This requires the strong structure in the developing unit, consequently the developing unit has large size and heavy in weight.

In addition, the first conventional wet-type developing unit needs a toner density controller to deal with consumption of charged particle toners and with decrease of the toner density. This causes increase of the size and the cost of the developing unit.

Figure 2A:
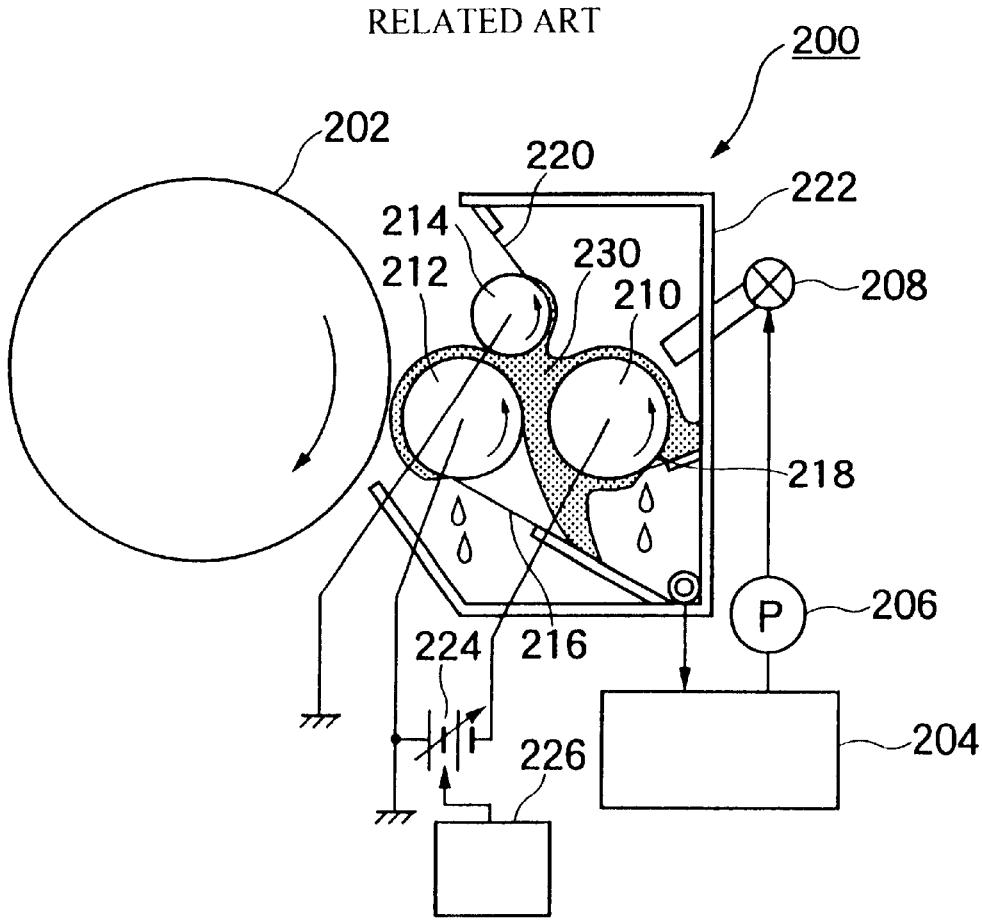
FIG. 2A RELATED ART
FIG. 2A is a schematic drawing of a second conventional wet-type developing unit.
Figure 2B:
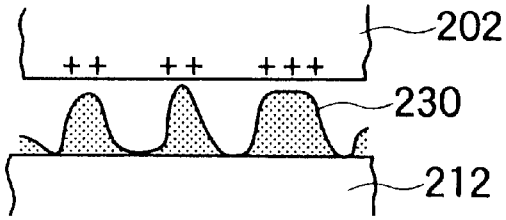
FIG. 2B RELATED ART
FIGS. 2B and 2C are drawings for describing an operation of a second conventional wet-type developing unit of FIG. 2A.
Figure 2C:
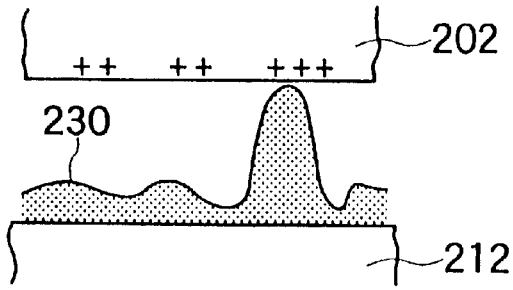

Referring to FIGS. 2A through 2C, a second conventional wet-type developing unit is described below.

In FIG. 2A, the developing unit 200 develops an electrostatic latent image formed on an outer peripheral surface of the photoreceptor drum 202.

The developing unit 200 comprises a developer tank 204, a pump 206, a nozzle 208, a supplying roller 210, a development roller 212, a squeeze roller 214, scrapers 216, 218 and 220, a casing 222, a variable power source 224, and a voltage controller 226.

The developer tank 204 stores liquid developer. The pump 206 pumps the liquid developer out the developer tank 204 to supply the nozzle 208 with the liquid developer. The nozzle 209 spouts out the liquid developer toward the supplying roller 210. The liquid developer is stored in a reservoir formed by an outer peripheral surface of the supplying roller and the scraper 216 which is in contact with or adjoins the outer peripheral surface of the supplying roller 210.

The supplying roller 210 rotates counterclockwise and supplies the liquid developer stored in the reservoir to the development roller 212.

The development roller 212 is a metallic roller having a smooth outer peripheral surface. The development roller 212 rotates counterclockwise while the liquid developer supplied from the supplying roller 210 partially moves toward the photoreceptor drum, 202 according to the rotation of the development roller 212.

The squeeze roller 214 is completely different from the squeeze roller 118 of FIG. 1 and disposed at a predetermined distance from the development roller 212. The squeeze roller 214 rotates counterclockwise and limits or thins thickness of a layer of the liquid developer 230 on the development roller 212. The thickness of the liquid developer layer remaining on the development roller 212 is mainly decided by a rotating speed ratio of the squeeze roller 214 to the developing roller 212. The rotating speed ratio, is decided so that the thickness is smaller than a gap (e.g. 30 $\mu$m) between the development roller 212 and the photoreceptor drum 202.

When the thinned liquid developer layer remaining on the developer roller 212 gets closer to the photoreceptor drum 202, it is attracted by the electric charges of the electrostatic latent image formed on the photoreceptor drum 202 as illustrated in FIG. 2B. Then the attracted liquid developer 230 adheres to the photoreceptor drum 202 corresponding to the electrostatic latent image. Consequently, the electrostatic latent image is developed and turns into a visible image.

Additionally, if the squeeze roller 214 does not exist, the liquid developer layer remaining on the developer roller 212 is large in thickness and the liquid developer 230 is attracted by higher charged area of the photoreceptor drum 202 as shown in FIG. 2C. Then undeveloped areas occur on the photoreceptor drum 202.

The scrapers 216 and 220 are in contact with the development roller 212 and the squeeze roller 214, respectively, to scrape the liquid developer 230 from them. The liquid developer 230 scraped by the scrapers 216 and 220 falls or runs down on the bottom of the casing 222. The fallen liquid developer 230 is gathered and returned to the developer tank 204.

Because the variable power source 224 gives potential difference between the supplying roller 210 and the development roller 212, electrophoresis is caused in the liquid developer 230 existing between them. That is, the development roller 212 attracts toners taking negative charges and increase toner density of the liquid developer layer adhered to the development roller 212 higher than the liquid developer 230 supplied from developer tank 204.

The voltage controller 226 controls the variable power source 224 to change the potential difference between the supplying roller 210 and the development roller 212. By changing the potential difference, the toner density of the liquid developer layer is changed and thereby density of the visible image is changed.

However, it is hard to exactly control the toner density of the liquid developer layer adhered on the development roller 212. This is because both of the development roller 212 and the supplying roller 210 are too large to exactly control the toner density of the liquid developer layer adhering to the development roller 212. That is, the development roller 212 and the supplying roller 210 serve as a large capacitor and greatly respond to change of the voltage supplied from the variable power source 224.

In addition, the developing unit inevitably has a large size because it has the supplying roller 210 and the squeeze roller 214 that are unnecessary in the first conventional wet-type developing unit.

Figure 3:
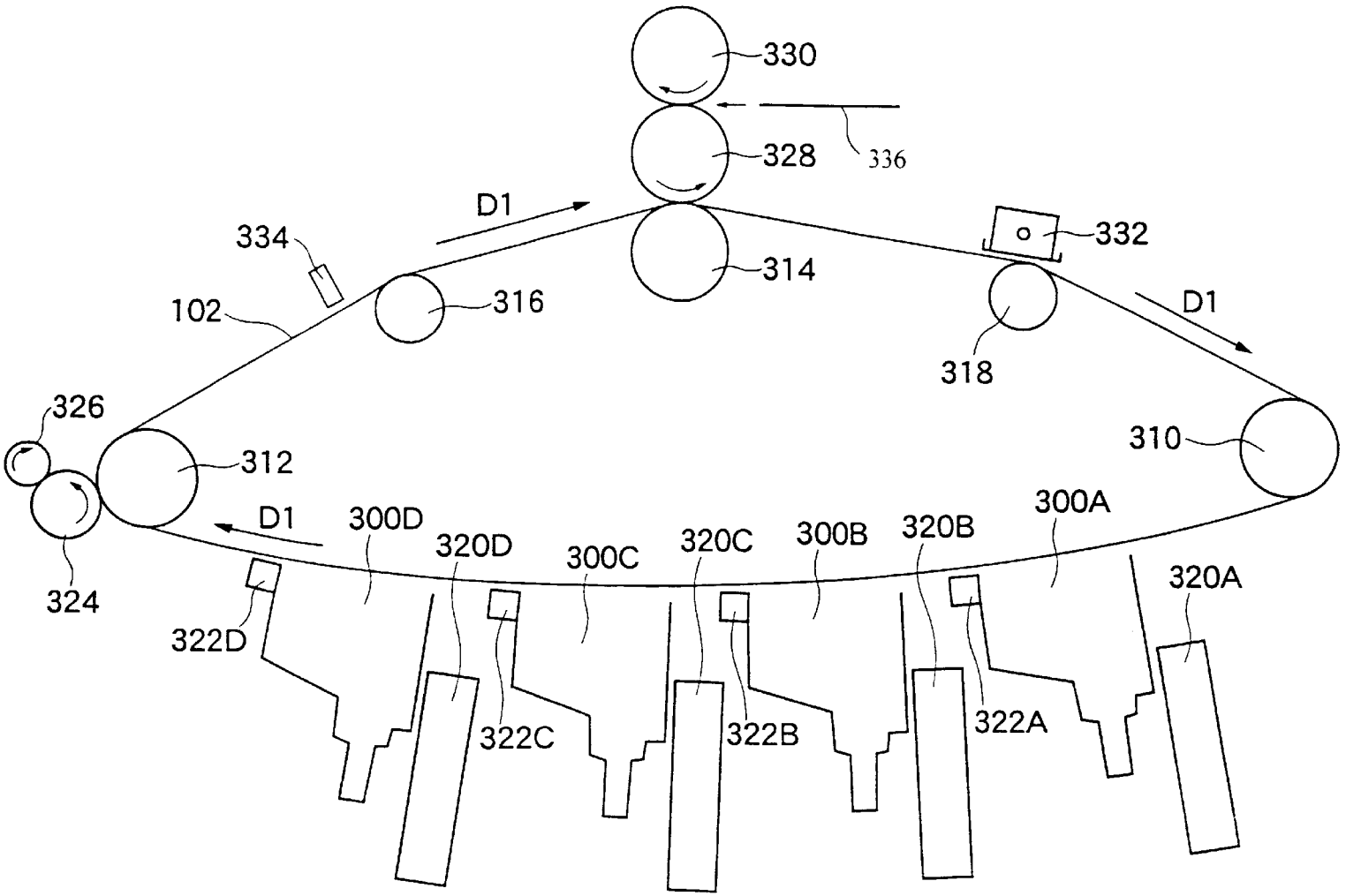
FIG. 3 is a schematic drawing of a tandem-type color laser printer to which a wet-type depositing unit of this invention is applicable.
Figure 4:
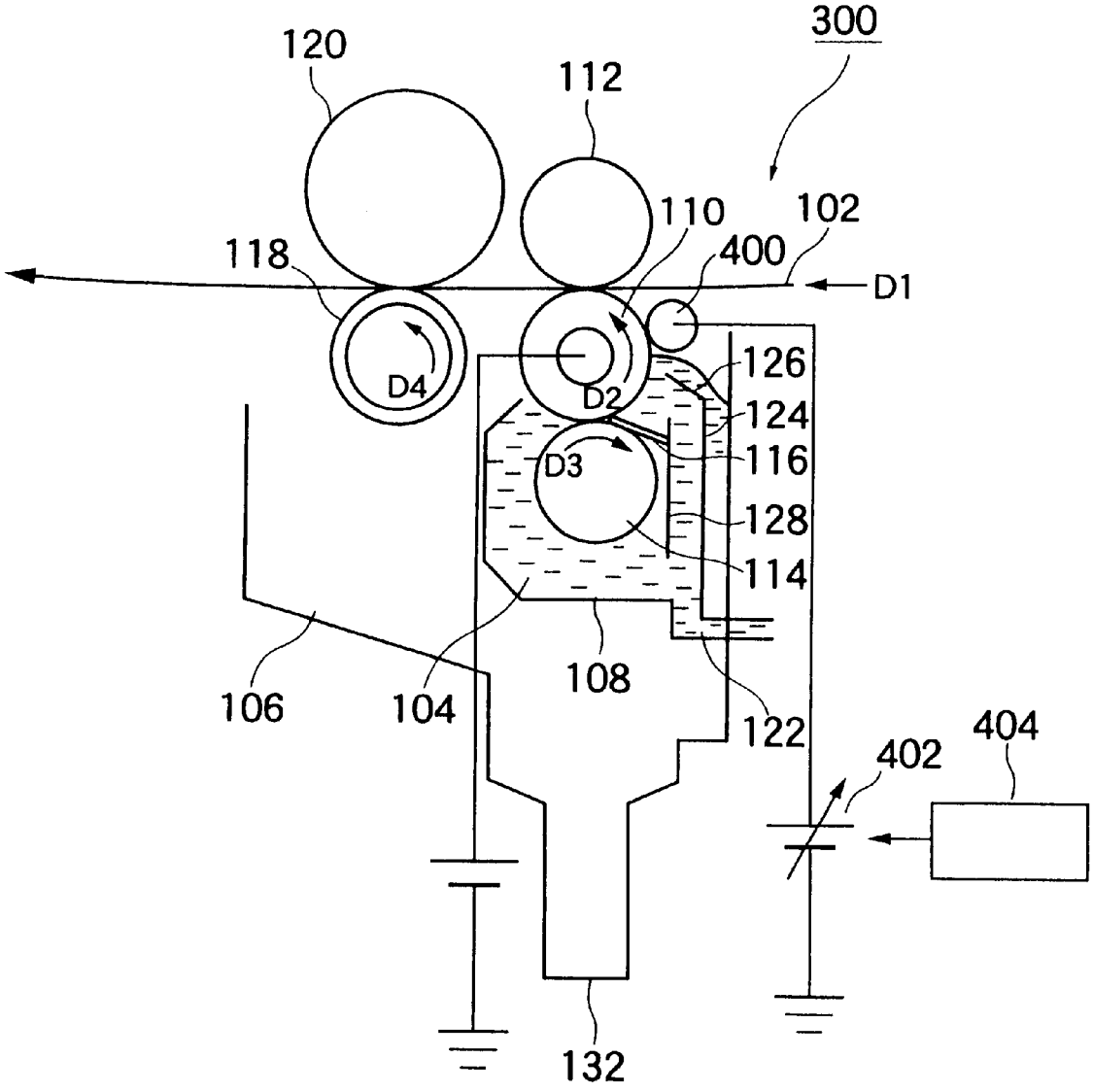
FIG. 4 is a schematic drawing of a wet-type developing unit according to a preferred embodiment of this invention.
Figure 5:
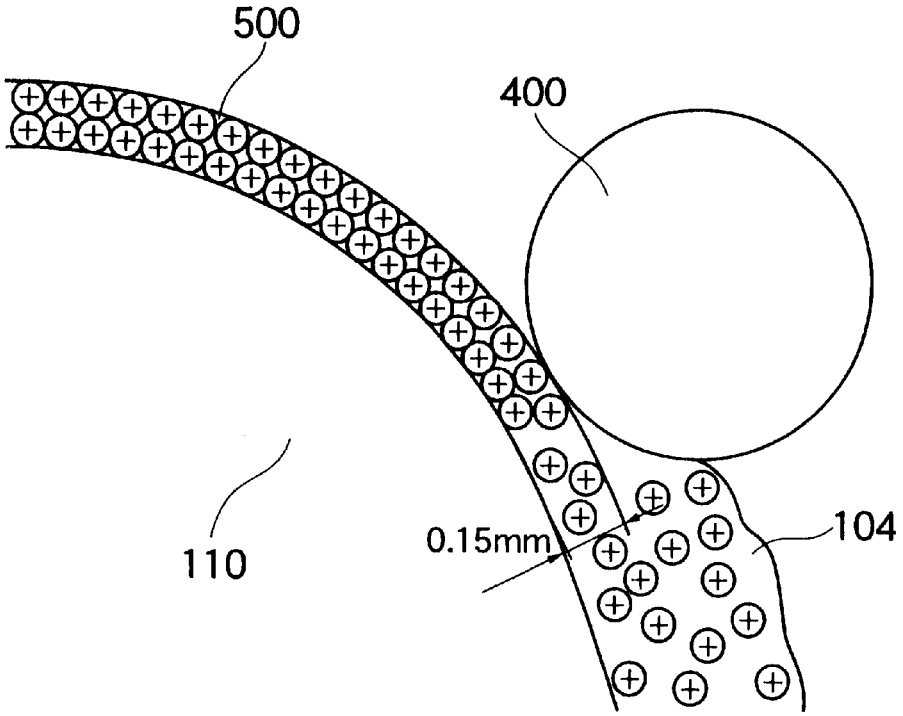
FIG. 5 is an enlarged drawing for describing an operation of a plating roller included in the wet-type developing of FIG. 4.

Referring to FIGS. 3 through 5, the description will proceed to a wet-type depositing unit according to a preferred embodiment of this invention. Similar parts are designated by like reference numerals.

FIG. 3 shows a tandem-type color laser printer to which the wet-type depositing unit 300 (300A–300D) is applicable. The printer comprises the photoreceptor belt 102 having an endless shape. Three driving rollers 310, 312 and 314 drive endless shape. Three driving rollers 310, 312 and 314 drive the photoreceptor belt 102 to circulate in the direction D1. Two guide roller 316 and 318 are guides the photoreceptor belt 102. First through fourth depositing unit 300A–300D are located along the photoreceptor belt 102 between the driving rollers 310 and 312. The first through the fourth depositing unit 300A–300D correspond to yellow, magenta, cyan, and black, respectively. First through fourth light sources 320A–320D are, for example, laser devices and directed to the photoreceptor belt 102 in preceding positions of the first through the fourth depositing unit (300A-300D) respectively. A drying roller 324 is located opposite to the driving roller 312 across the photoreceptor belt 102 to press the photoreceptor belt 102. A regenerating roller 326 is in contact with the drying roller 324. A transfer roller 328 is located opposite to the driving roller 314 across the photoreceptor 102 and press the photoreceptor 102. A fixing roller 330 faces the transfer roller 328. A principal electrifying device 332 is located opposite to the guide roller 318 across the photoreceptor belt 102. A sensor 334 is directed to the photoreceptor belt 102 at a following position of the drying roller 324.

The photoreceptor belt 102 comprises a conductive resin film, a photo sensitive layer formed on the conductive resin film, a barrier layer formed on the photo sensitive layer to protect the photo sensitive layer, and a release layer formed on the barrier layer to make easy to separate the liquid developer from the photoreceptor belt 102.

The drying roller 324 comprises metallic cylinder having 20–50 mm in diameter and a peripheral surface coated by an elastic coat made of a forming member or silicone. The drying roller 324 has a heat source (e.g. a heater) (not shown) to heat its surface to 50–100° C. The drying roller 324 deforms and has a nip of 3–6 mm in width by pressing the photoreceptor belt 102.

The drying roller 324 rotates according to circulation of the photoreceptor belt 102 and dries the visible image pattern so that the solid component ratio in the visible image pattern becomes 90–98 percents.

The regenerating roller 326 is similar to the drying roller except for the diameter, which is 10–30 mm. A surface temperature of the regenerating roller 326 is higher than that of the drying roller 324 by 10–20° C. The regenerating roller 326 deforms and has a nip of 1–3 in width by pressing the drying roller 324. The regenerating roller 326 rotates in a direction opposite to that of the drying roller 324 and dries the surface of the drying roller 324 to prevent keeping wet.

The transfer roller 328 comprises a metallic cylinder having 30–70 mm in diameter, a rubber member coating a peripheral surface of the metallic cylinder, and a heat source (not shown) for heating a surface of the rubber member to 40–100° C. The transfer roller 328 presses the photoreceptor belt 102 so as to have a nip of 3–6 mm in width. The transfer roller 328 rotates according to the circulation of the photoreceptor belt 102 and transfer the visible pattern from the photoreceptor belt 102 to itself.

The fixing roller 330 comprises a metallic cylinder having 50–62 mm in diameter and a heat source (not shown). The heat source heats the metallic cylinder so that a peripheral surface of the metallic cylinder has temperature higher than that of the transfer roller 328 by 10–40° C. The fixing roller 330 presses the transfer roller 328 so as to have a nip of 3–6 mm in width. The fixing roller 330 rotates in a direction opposite to that of the transfer roller 328 and transfers the visible image pattern transferred to the transfer roller 328 to a paper 336 together with the transfer roller 328.

The principal electrifying device 332 is, for example, a corotoron, a scorotoron, an electrifying belt, or a electrifying brush. The principal electrifying device 332 electrifies the photoreceptor belt 102.

The assist electrifying devices 322A–322D are electrify the photoreceptor belt 102 to replenish the photoreceptor belt 102 with charges corresponding to lost charges lost by development.

The sensor 334 is, for example, an optical reflection sensor and detects a density of the visible image pattern.

Turning to FIG. 4, each wet-type developing unit 300 is generally similar to the first conventional wet-type developing unit except for the following points.

The wet-type developing unit 300 comprises a plating roller 400 as an electrode member, a variable power source 402 connected to the plating roller 400, and a voltage controller 404 connected to the power source 402.

The plating roller 400 is made of metal, such as stain less steel or aluminum, and has a cylindrical shape having a diameter of 5–10 mm and the same length as the development roller 110 has. The plating roller 400 is disposed parallel to the development roller 110 and over the bent section 126 of the inner wall 124 so that there is a gap of 0.15 mm between the plating roller 400 and the development roller 110 as shown in FIG. 5. The plating roller 400 is supplied with a voltage from the power source 402 to have a higher electric potential than the development roller 110 by 200–1000 V. The plating roller 110 is driven clockwise or counterclockwise by the driving system. Additionally, the bent section 126 is lower than that of the conventional wet-type developing unit 100.

The voltage controller 404 is further connected to the sensor 334 of FIG. 3 and controls the voltage supplied to the plating roller 400 according to the density detected by the sensor 334.

In the wet-type developing unit 300, the squeeze roller 118 presses the photoreceptor belt 102 by pressing power of 5–20 kg (preferably 10–20 kg). The pressing power is smaller than that of the conventional wet-type developing unit 100. The squeeze roller 118 has 310–335 mm in length and 15–22 mm in diameter and has an elastic coat, such as rubber, coating a peripheral surface of an aluminum or stainless steel shaft.

Returning to FIG. 3, an operation of the color laser printer will be disclosed soon.

The driving rollers 310 and 312 drive the photoreceptor belt 102 to circle it. When a predetermined area of the photoreceptor belt 102 faces to the principal electrifying device 332, the principal electrifying device 332 electrifies the predetermined area. That is, the predetermined area takes positive charges when it faces to the principal electrifying device 332.

The first light source 320A applies a light beam to the predetermined area to form a yellow part of the electrostatic latent image. The yellow part has a lower electric potential than that of the other area of the predetermined area.

The first wet-type developing unit 300A develops the yellow part of the electrostatic latent image to form a yellow component of the visible image pattern on the photoreceptor belt 102.

The first assistant electrifying device 322A electrifies the predetermined area again to equalize the electric potential of the yellow put with that of the other part of the predetermined area.

Similarly, the second, third, and fourth light source 320B–320D forms magenta, cyan, and black parts of the electrostatic latent image in the predetermined area, respectively. The second, third, and forth wet-type developing units 300B–300D form magenta, cyan, and black components of the visible image pattern that correspond to the magenta, the cyan, and the black parts of the electrostatic latent image, respectively. The second, the third, and the fourth assistant electrifying devices 322B–322D equalize the electric potential of the predetermined area by electrifying the predetermined area.

Thus, the visible image pattern is formed on the photoreceptor belt 102.

If the laser printer has no assistant electrifying device, the electric potential of the predetermined area on the photoreceptor belt 102 decreases. The decrease of the electric potential brings undesirable adhesion of the liquid developer.

When the predetermined area of the photoreceptor belt 102 reaches the drying roller 324, the drying roller 324 dries the visible image pattern by heating and pressing. That is, the drying roller 324 removes most of the insulation liquid from the visible image pattern to increase the solid component ratio in the visible image pattern to 90–98 percents.

When the visible image pattern formed in the predetermined area on the photoreceptor belt 102 is carried to the transfer roller 328, the transfer roller 328 transfers the visible image pattern to its peripheral surface. The paper 334 is supplied from a paper feeder (not shown) between the transfer roller 328 and the fixing roller 330 in synchronization with arrival of the visible image pattern transferred on the transfer roller 328 to between the transfer roller 328 and the fixing roller 330. The transfer roller 328 and the fixing roller 330 cooperate with each other to transfer the visible image pattern from the transfer roller 328 to the paper 334. In this event, the fixing roller 330 gives heat and pressure to the paper and the visible image pattern.

Thus, the visible image pattern is transferred to the paper 334 and fixed there.

Next, the description about an operation of the wet-type developing unit 300 will be made soon with referring to FIGS. 4 and 5.

The development roller 110 is supplied with the liquid developer 104 by guiding of the bent section 126 and carries the liquid developer 104 as the liquid developer film adhered on its outer peripheral surface toward the developing area. As shown in FIG. 5, the plating roller 400 incompletely prevents passing of the liquid developer 104 between the plating roller 400 and the developing roller 110. In this event, most of the charged particle toners on the development roller 110 passes through between the plating roller 400 and the developing roller 110 toward the developing area because the development roller 110 and the plating roller 400 are supplied with different voltage. That is, because an electric field is formed between the development roller 110 and the plating roller 400 and moves the charged particle toners toward the development roller 110, insulation liquid is considerably removed from the liquid developer on the development roller 110. Thus a high density charged particle toner film 500 is formed on the peripheral surface of the development roller 110.

When the high density charged particle toner film 500 is carried to the developing area and the electrostatic latent image formed on the photoreceptor belt 102 is in the developing area, the high density charged particle toner film 500 is partially transferred to the photoreceptor belt 102 by an electric field between the development roller 110 and the photoreceptor belt 102. Thus the electrostatic latent image is developed with the high density charged particle toner film 500.

The high density charged particle toner film 500 still includes the insulation liquid after it is transferred to the photoreceptor belt 120. Then the squeeze roller 118 squeeze the high density charged particle toner film 500 on the photoreceptor belt 102 to remove the insulation liquid included in it.

Thus, the development is carried out in the wet-type developing unit 300.

By the development, the charged particle toners are consumed and thereby the solid component ratio of the liquid developer 104 supplied to the development roller 110 decreases. This is because most of the insulation liquid is not consumed in the development and returned to the developer storage tank. The voltage controller 404 finds the decrease of the solid component ratio on the basis of a sensor signal supplied from the sensor 334 (see FIG. 3). Then the voltage controller 404 controls the power supply 402 to change the voltage supplied to the plating roller 400 so that the solid component ratio of the high density charged particle toner film 500 is maintained at an even value.

Figure 6:
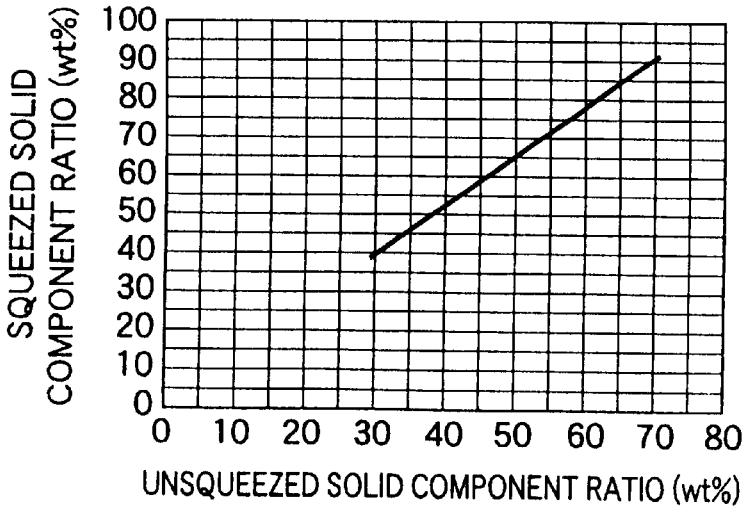
FIG. 6 is a graph representing variation of solid component ratio of a visible image pattern between before and after squeeze.

In FIG. 6, variation of solid component ratio of visible image patterns between before and after squeeze is illustrated. The variation is found on experiment. In each experiment, a polyethylene terephthalate (PET) film having an aluminum electrode is located between two metal plates which is parallel to each other and which have a gap of 0.3 mm between them. Liquid developer having positive charged particle toners dispersed in insulation liquid ie filled in the gap. Then the PET film is supplied with a negative voltage and has negative charges. Thus, the PET film, is developed with the liquid developer to form the visible image pattern.

A plurality of pairs of PET films are developed by the use of above mentioned method under different conditions (i.e. different negative voltages). Each pair of the PET films is developed under the same condition. With regard to one of each pair, an unsqueezed solid component ratio of the visible image pattern thereon in found. The other is pressed by a squeeze roller with a definite pressure and then a squeezed solid component ratio of the visible image pattern thereon is found.

In FIG. 6, the horizontal axis is used for the unsqueezed solid component ratio while the vertical axis is used for the squeezed solid component ration.

As easily understood from FIG. 6, the squeezed solid component ratio becomes high when the unsqueezed solid component ratio becomes high. This means that the pressure given by the squeezed roller 118 can be decrease if the solid component ration of the liquid developer 104 adhered on the developing roller 110. In this embodiment, the pressure given by the liquid developer 104 can be decrease because the plating roller 400 increases the solid component ration of the liquid developer 104 adhered on the developing roller 110 as mentioned above. Therefore, the strong structure for the conventional wet-type developing unit 100 is needless in the wet-type developing unit 300. Thus, the wet-type developing unit 300 can be miniaturized and lightened.

Figure 7:
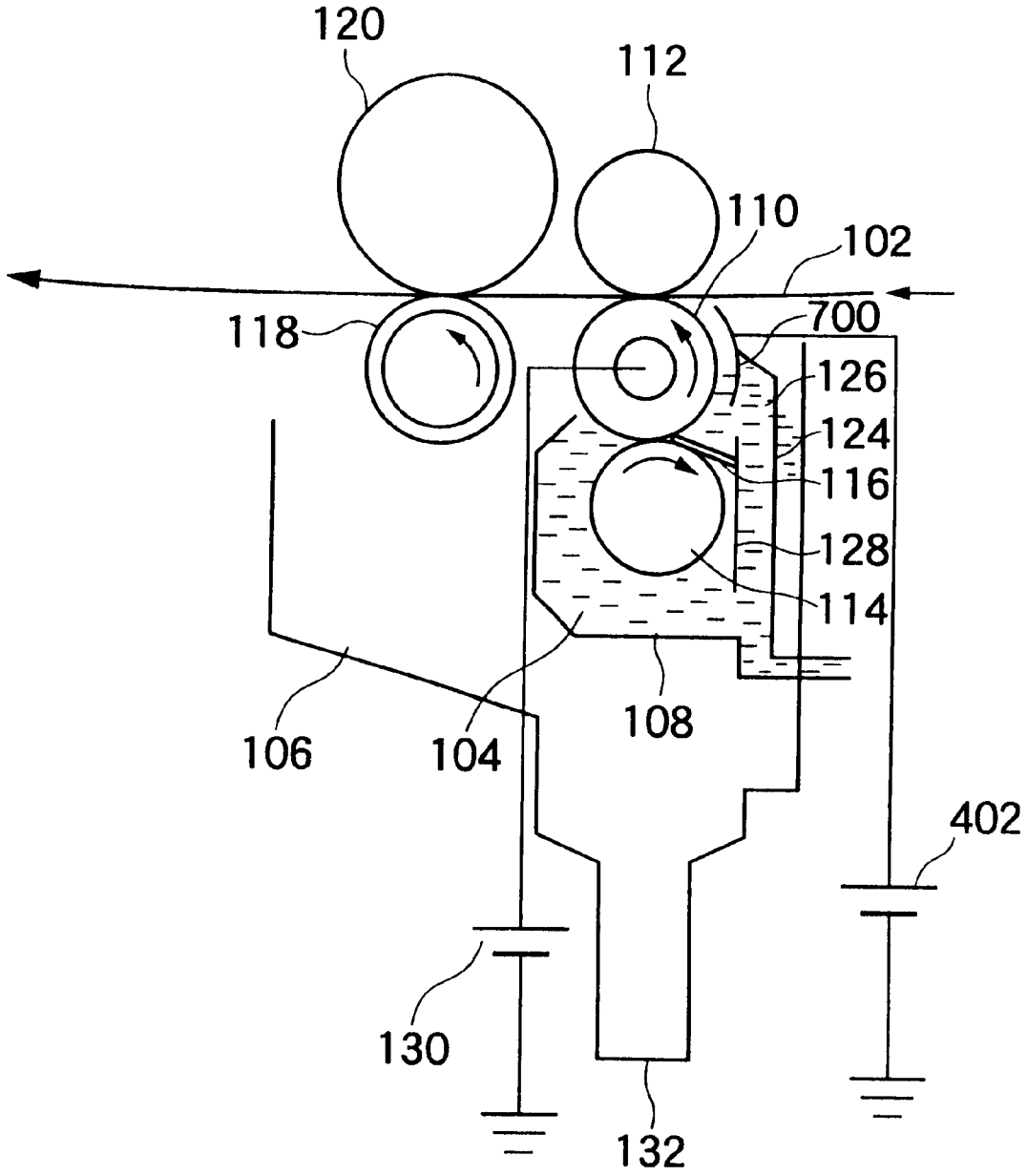
FIG. 7 is a schematic drawing of a wet-type developing unit according to another embodiment of this invention.

While this invention has thus far been described in conjunction with the preferred embodiment thereof, it will readily be possible for those skilled in the art to put this invention into practice in various other manners. For example, the plating roller 400 may be replaced with an electrode plate 700 shown in FIG. 7. The electrode plate 700 may be fixed to the inner wall 124 or formed in a single form together with the inner wall 124. The electrode plate 700 is curved so as to be concentric with the outer peripheral surface of the development roller 110. In addition, the electrode plate 700 may have a lower edge that is warped toward the opposite direction so as to guide the charged particle toners toward the development roller 110. The electrode plate 700 needs a small space smaller than that needed by the plating roller 400 of FIG. 4.

Accordingly, the wet-type development unit can be further miniaturized and lightened.

What is claimed is:

1. A wet-type developing unit for developing an electrostatic latent image formed on a photoreceptor by using a liquid developer, having charged toner particles, said wet-type developing unit, comprising:

a reservoir that stores said liquid developer, said reservoir having an inner wall;

a development roller, having an outer peripheral surface wetted by a film of said liquid developer, to develop said electrostatic latent image;

an electrode member located at a predetermined distance from said outer peripheral surface of said development roller, to reduce a thickness of said film of said liquid developer, and having a voltage relative to said development roller that causes said charged toner particles to move from said electrode member toward said outer peripheral surface of said development roller; and a sensor that senses an optical density of a developed image and produces a sensor signal, which corresponds to said voltage applied to said electrode member, wherein said electrode member comprises a metal plate, and said metal plate and said inner wall are formed in a single form.

2. A wet-type developing unit for developing an electrostatic latent image formed on a photoreceptor by using a liquid developer, said wet-type developing unit, comprising:

a development roller, having an outer peripheral surface wetted by a film of said liquid developer, to develop said electrostatic latent image on said photoreceptor;

an electrode member that increases a solid component ratio of said film of said liquid developer on said outer peripheral surface of said development roller by applying a voltage from about 200 V to about 1000 V between said electrode member and said development roller, said electrode member being located a predetermined distance from said outer peripheral surface of said development roller, above a reservoir level of said liquid developer, and upstream of a region where said film of said liquid developer is applied to said photoreceptor; and a squeeze roller, located downstream from said region where said film of said liquid developer is applied to said photoreceptor, that squeezes said photoreceptor between said squeeze roller and a backup roller with a pressing power from about 5 kg. to about 20 kg.

3. A wet-type developing unit as claimed in claim 2, wherein said electrode member comprises a roller having a metallic peripheral surface.

4. A wet-type developing unit as claimed in claim 3, wherein said electrode member comprises a plating roller.

5. A wet-type developing unit as claimed in claim 2, wherein said electrode member comprises a metal plate.

6. A wet-type developing unit as claimed in claim 5, wherein said metal plate comprises a bent shape.

7. A wet-type developing unit as claimed in claim 2, further comprising a voltage controller that controls said voltage applied to said electrode member.

8. A wet-type developing unit as claimed in claim 7, said wet-type developing unit further comprising a sensor for sensing a density of a developed image that produces a sensor signal, wherein said voltage controller controls a voltage applied to said electrode member according to said sensor signal.

9. A wet-type developing unit as claimed in claim 2, wherein said development roller is applied with an additional voltage.

10. A wet-type developing unit as claimed in claim 2, wherein said squeeze roller comprises a metal shaft having a peripheral surface coated by an elastic member.

11. A wet-type developing unit as claimed in claim 2, wherein said photoreceptor comprises a belt shape and said wet-type developing unit further comprises another backup roller for maintaining an even gap between said photoreceptor and said development roller.

12. An electrographic apparatus including a wet-type developing unit for developing an electrostatic latent image formed on a photoreceptor by using a liquid developer, said wet-type developing unit, comprising:

a development roller, having an outer peripheral surface wetted by a film of said liquid developer, to develop said electrostatic latent image on said photoreceptor;

an electrode member that increases a solid component ratio of said film of said liquid developer on said outer peripheral surface of said development roller by applying a voltage from about 200 V to about 1000 V between said electrode member and said development roller, said electrode member being located a predetermined distance from said outer peripheral surface of said development roller, above a reservoir level of said liquid developer, and upstream of a region where said film of said liquid developer is applied to said photoreceptor; and a squeeze roller, located downstream from said region where said film of said liquid developer is applied to said photoreceptor, that squeezes said photoreceptor between said squeeze roller and a backup roller with a pressing power from about 5 kg. to about 20 kg.

13. An electrographic apparatus according to claim 12, further comprising a voltage controller that controls said voltage applied to said electrode member.

* * * * *